US010049641B2

(12) United States Patent
Wang

(10) Patent No.: US 10,049,641 B2
(45) Date of Patent: Aug. 14, 2018

(54) DRIVING CIRCUIT, DISPLAY DEVICE AND METHOD FOR IMPLEMENTING EQUAL RESISTANCE OF A PLURALITY OF TRANSMISSION LINES

(71) Applicants: BOE TECHNOLOGY GROUP CO., LTD., Beijing (CN); BEIJING BOE DISPLAY TECHNOLOGY CO., LTD., Beijing (CN)

(72) Inventor: Xiao Wang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 12 days.

(21) Appl. No.: 14/307,990

(22) Filed: Jun. 18, 2014

(65) Prior Publication Data

US 2015/0310823 A1 Oct. 29, 2015

(30) Foreign Application Priority Data

Apr. 23, 2014 (CN) ..... 2014 1 0165645

(51) Int. Cl.
*G09G 5/00* (2006.01)

(52) U.S. Cl.
CPC ..... *G09G 5/006* (2013.01); *G09G 2320/0223* (2013.01); *G09G 2370/08* (2013.01)

(58) Field of Classification Search
None
See application file for complete search history.

(56) References Cited

U.S. PATENT DOCUMENTS 8,614,650 B2 * 12/2013 Wilson ..... H01Q 1/007 343/860
9,448,665 B2 * 9/2016 Lee ..... G06F 3/042
2003/0117356 A1 * 6/2003 Moon ..... G02F 1/13452 345/87
2007/0195035 A1 * 8/2007 Song ..... G02F 1/13452 345/87

(Continued)

FOREIGN PATENT DOCUMENTS

CN 1560669 A 1/2005
CN 1716064 A 1/2006

(Continued)

OTHER PUBLICATIONS

First Office Action regarding Chinese application No. 201410165645.0, dated Nov. 30, 2015. Translation provided by Dragon Intellectual Property Law Firm.

(Continued)

*Primary Examiner* — Premal Patel
*Assistant Examiner* — Douglas M Wilson
(74) *Attorney, Agent, or Firm* — Harness, Dickey & Pierce, P.L.C.

(57) ABSTRACT

The present disclosure provides a driving circuit, comprising a plurality of transmission lines in one-to-one correspondence to a plurality of gate driving circuits and configured to transmit a control signal to the corresponding gate driving circuit; and a compensating resistor coupled to the corresponding transmission line so as to compensate for a resistance difference among the plurality of transmission lines.

3 Claims, 3 Drawing Sheets

(56) References Cited

U.S. PATENT DOCUMENTS

| | | | | |
|---|---|---|---|---|
| 2008/0049156 | A1* | 2/2008 | Kim | G02F 1/136286 349/40 |
| 2008/0062109 | A1* | 3/2008 | Kim | G02F 1/13452 345/92 |
| 2008/0168415 | A1* | 7/2008 | Staiger | G06F 17/5068 716/102 |
| 2011/0004860 | A1* | 1/2011 | Staiger | G06F 17/5068 716/137 |
| 2011/0074743 | A1* | 3/2011 | Son | G09G 3/20 345/204 |
| 2012/0105386 | A1* | 5/2012 | He | G06F 3/1438 345/204 |
| 2012/0266127 | A1* | 10/2012 | Staiger | G06F 17/5068 716/137 |

FOREIGN PATENT DOCUMENTS

| | | | |
|---|---|---|---|
| CN | 1904678 | A | 1/2007 |
| CN | 101667396 | A | 3/2010 |
| CN | 103035214 | A | 4/2013 |

OTHER PUBLICATIONS

Second Office Action regarding Chinese application No. 201410165645.0, dated Aug. 3, 2016. Translation provided by Dragon Intellectual Property Law Firm.

* cited by examiner

-Prior Art-

DRIVING CIRCUIT, DISPLAY DEVICE AND METHOD FOR IMPLEMENTING EQUAL RESISTANCE OF A PLURALITY OF TRANSMISSION LINES

CROSS-REFERENCE TO RELATED APPLICATION

The present application claims a priority of the Chinese patent application No. 201410165645.0 filed on Apr. 23, 2014, which is incorporated herein by reference in its entirety.

FIELD OF THE INVENTION

The present disclosure relates to the field of display technology, in particular to a driving circuit, a display device and a method for implementing equal resistance of a plurality of transmission lines.

DESCRIPTION OF THE PRIOR ART

Referring to FIG. 1, which is a schematic view showing an existing display device, the display device comprises gate driving circuits (Gate ICs) Y1, Y2, Y3, a source driving circuit (Source IC) X, and a printed circuit board (PCB). The gate driving circuits Y1, Y2 and Y3 are coupled to the source driving circuit X via at least one connection gate (PLG) line 101 arranged on an array substrate, and then coupled to a sequence controller on the PCB via a connection wire 102, so as to receive gate control signals transmitted by the sequence controller, e.g., an initial scanning start signal (STV), a driving clock signal (CPV), a gate on-state signal (Von), and a gate off-state signal (Voff), and so on.

The resistance of a transmission line for transmitting Voff corresponding to each gate driving circuit (principally the resistance of the PLG line on the transmission line) will remarkably affect the synchronization of the Voff signals received by the respective gate driving circuits, and thereby affect the display quality of the display device. Hence, it is required to keep total resistance of the Voff PLG lines between the source driving circuit and each gate driving circuit consistent.

In the prior art, the resistance of each Voff PLG line is set accurately so as to reduce the total resistance difference among the Voff PLG lines between the source driving circuit and each gate driving circuit. However, due to the manufacturing process, the resistance of each Voff PLG line cannot be controlled accurately, and thereby it is very difficult to implement equal resistance of the transmission lines.

SUMMARY OF THE INVENTION

An object of the present disclosure is to provide a driving circuit, a display device and a method for implementing equal resistance of a plurality of transmission lines, so as to accurately implement the equal resistance of the transmission lines for transmitting predetermined control signals to gate driving circuits.

In one aspect, the present disclosure provides a driving circuit, comprising: a plurality of transmission lines in one-to-one correspondence to a plurality of gate driving circuits and configured to transmit a control signal to the corresponding gate driving circuit; and a compensating resistor coupled to the corresponding transmission line so as to compensate for a resistance difference among the plurality of transmission lines.

The transmission lines may comprise connection gate lines through which a source driving circuit is coupled to each gate driving circuit, and the resistance of the transmission lines is a sum of the resistance of all connection gate lines on the transmission lines. The compensating resistor may be arranged on a PCB.

The transmission lines may further comprise a connection wire for coupling the source driving circuit and a sequence controller on the PCB, and the compensating resistor may be arranged on the connection wire. The control signal may be a Voff signal or a Von signal.

In another aspect, the present disclosure provides a display device comprising the above-mentioned driving circuit.

In yet another aspect, the present disclosure provides a method for implementing equal resistance of a plurality of transmission lines in one-to-one correspondence to a plurality of gate driving circuits and configured to transmit a control signal to the gate driving circuits, comprising the steps of: acquiring the resistance of each transmission line after the transmission lines have been prepared; calculating a resistance difference among the plurality of transmission lines; and coupling the corresponding transmission line to a compensating resistor in accordance with the resistance difference among the plurality of transmission lines, so as to compensate for the resistance difference among the plurality of transmission lines.

The transmission lines may comprise connection gate lines through which a source driving circuit is coupled to each gate driving circuit, and the resistance of the transmission lines may be a sum of the resistance of all connection gate lines on the transmission lines.

Prior to the step of acquiring the resistance of each transmission line, the method may further comprise: coupling a zero-ohm resistor to each transmission line in advance. The step of coupling the corresponding transmission line to the compensating resistor in accordance with the resistance difference among the plurality of transmission lines may comprise: replacing the zero-ohm resistor of the corresponding transmission line with the compensating resistor in accordance with the resistance difference among the plurality of transmission lines, so as to compensate for the resistance difference among the plurality of transmission lines. The control signal may be a Voff signal.

The present disclosure has the following advantageous effects. By coupling the corresponding transmission line to the compensating resistor, it is able to compensate for the resistance difference among the transmission lines, thereby to implement the equal resistance of the transmission lines accurately. In addition, it is able to facilitate the implementation and reduce the cost.

DETAILED DESCRIPTION OF THE PREFERRED EMBODIMENTS

In order to make the objects, the technical solutions and the advantages of the present invention more apparent, the present invention will be described hereinafter in conjunction with the drawings and the embodiments.

The present disclosure provides a driving circuit, comprising: a plurality of transmission lines in one-to-one correspondence to a plurality of gate driving circuits and configured to transmit a control signal to the gate driving circuits; and a compensating resistor coupled to the corresponding transmission line so as to compensate for a resistance difference among the plurality of transmission lines.

The transmission line may be configured to couple the gate driving circuit and a sequence controller on a PCB, and the sequence controller transmits the control signal to the gate driving circuit via the transmission line. Each gate driving circuit corresponds to an individual transmission line.

Among the control signals transmitted by the sequence controller to the gate driving circuit, a Voff signal has a high demand for synchronization. Hence, in this embodiment, the control signal may be the Voff signal, i.e., the transmission line is configured to transmit the Voff signal. Of course, the control signal may be any other signals, e.g., a Von signal. In a specific design, the sequence controller on the PCB may be usually coupled to the gate driving circuit via a source driving circuit.

Figure 1:
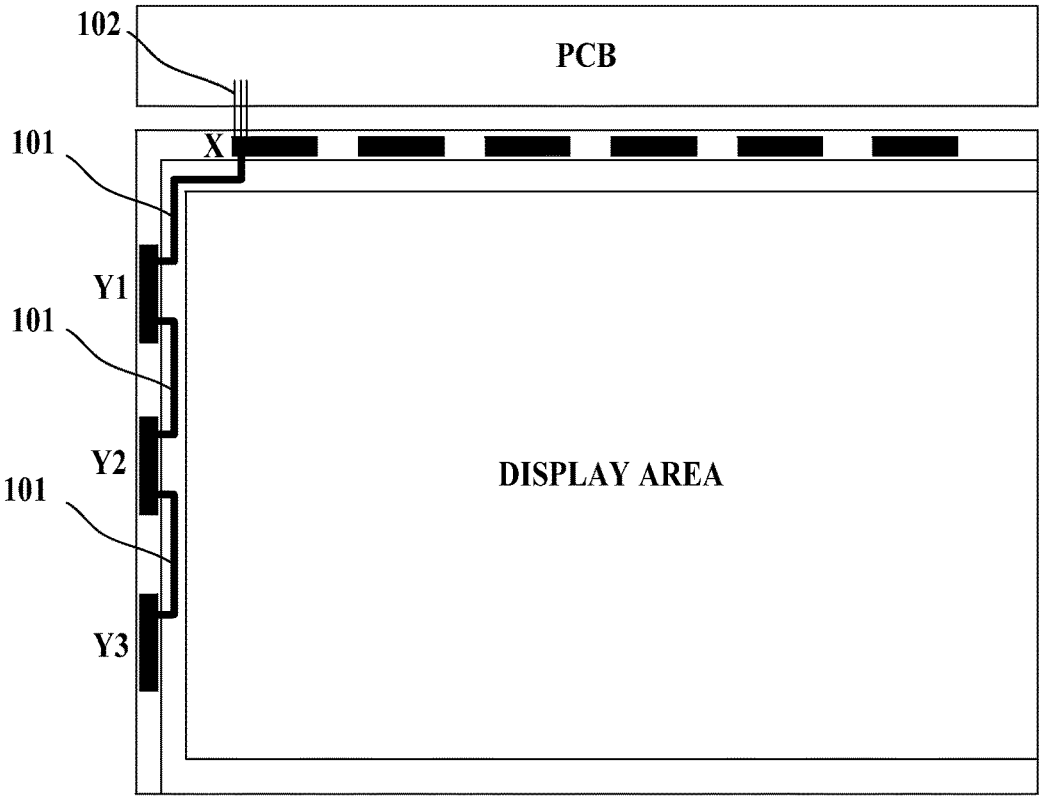
FIG. 1 is a schematic view showing an existing display device.
Figure 2:
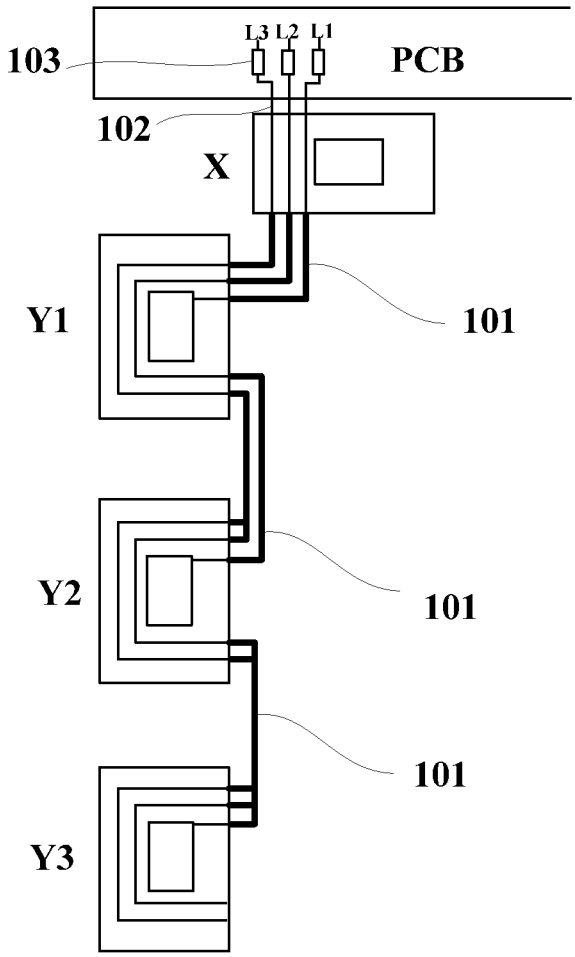
FIG. 2 is a schematic view showing transmission paths according to one embodiment of the present invention.

Referring to FIG. 2, which is a schematic view showing transmission paths according to one embodiment of the present invention, there are three transmission paths, i.e., a transmission path L1 for transmitting the control signal to the gate driving circuit Y1, a transmission path L2 for transmitting the control signal to the gate driving circuit Y2 and a transmission path L3 for transmitting the control signal to the gate driving circuit Y3.

As shown in FIG. 2, the sequence controller (not shown) on the PCB is coupled to the gate driving circuits Y1, Y2 and Y3 via the source driving circuit X. Generally, the source driving circuit X is one that is closest to the gate driving circuit. In this embodiment, merely three gate driving circuits are shown, and it should be appreciated that the number of the gate driving circuits is not limited thereto.

The source driving circuit X may be coupled to the gate driving circuits Y1, Y2 and Y3 via at least one PLG line 101. To be specific, the source driving circuit X may be coupled to the gate driving circuit Y1 via one PLG line 101 (the PLG line between X and Y1), to the gate driving circuit Y2 via two PLG lines 101 (the PLG lines between X and Y1, and between Y1 and Y2), and to the gate driving circuit Y3 via three PLG lines 101 (the PLG lines between X and Y1, between Y1 and Y2, and between Y2 and Y3).

In other words, the transmission lines for transmitting the control signal to the corresponding gate driving circuits may include at least one PLG line, through which the source driving circuit is coupled to each gate driving circuit. The PLG line may be coupled between the source driving circuit and the gate driving circuit, or between two gate driving circuits.

As shown in FIG. 2, apart from the PLG line 101, the transmission lines for transmitting the control signal to the corresponding gate driving circuits may further include connection lines located within the source driving circuit and the gate driving circuits, and a connection wire 102 for coupling the source driving circuit and the sequence controller on the PCB.

Because, as compared with the PLG lines, the resistance of the connection lines located within the source driving circuit and the gate driving circuits and the connection wire 102 for coupling the source driving circuit and the sequence controller on the PCB may almost be ignored, in this embodiment, the resistance of the transmission lines is just the sum of the resistance of all PLG lines on the transmission lines.

In this embodiment, in order to reduce the resistance difference among the transmission lines, the total resistance of the PLG lines on each transmission line shall be kept consistent as possible when the PLG lines 101 are prepared.

Taking the transmission lines in FIG. 2 as an example, when the PLG lines are prepared, the resistance of each PLG line 101 may be controlled as accurate as possible, as shown in the following Table.

| Transmission Line | Resistance of PLG line between X and Y1 (Ω) | Resistance of PLG line between Y1 and Y2 (Ω) | Resistance of PLG line between Y2 and Y3 (Ω) | Total resistance (Ω) |
|---|---|---|---|---|
| L1 | 23.8 | nil | nil | 23.8 |
| L2 | 11.02 | 12.76 | nil | 23.8 |
| L3 | 8.14 | 10.54 | 5.12 | 23.8 |

In other words, the resistance of each PLG line on the transmission line is controlled as accurate as possible just when the PLG lines are prepared, so as to ensure the equal total resistance of the PLG lines on the transmission lines as possible. For the resistance difference due to the manufacturing process, it may be compensated by the compensating resistor.

As shown in FIG. 2, in this embodiment, the compensating resistor 103 is arranged on the PCB and coupled to the connection wire 102 on the PCB.

Through the above-mentioned driving circuit, it is able to measure the resistance of each PLG line after it has been prepared, thereby to determine the resistance difference among the transmission lines. On the PCB, the compensating resistor is coupled to the corresponding transmission line, so as to compensate for the resistance difference among the transmission lines. As a result, it is able to implement the equal resistance of the transmission lines accurately, to facilitate the implementation and to reduce the cost.

The present disclosure further provides a display device comprising the above-mentioned driving circuit. The display device may any product or member having a display function, such as a liquid crystal display (LCD) panel, an electronic paper, an organic light-emitting diode (OLED) panel, a mobile phone, a tablet PC, a TV, a display, a laptop PC, a digital photo frame and a navigator.

Figure 3:
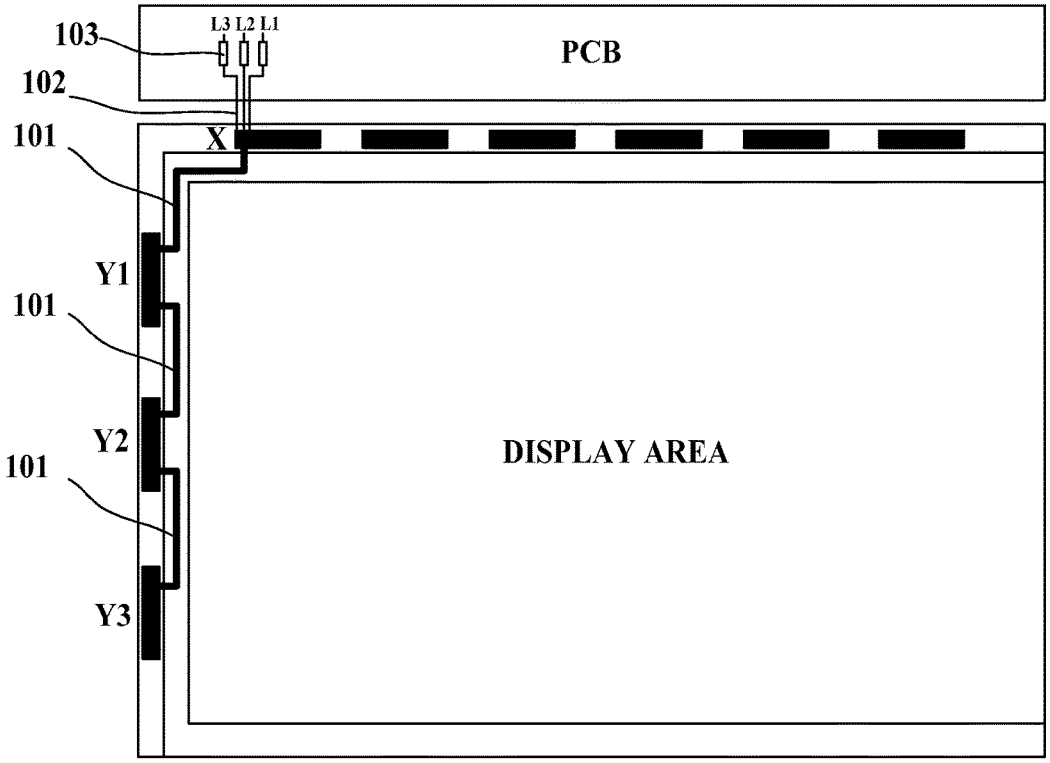
FIG. 3 is a schematic view showing a display device according to one embodiment of the present invention.

Referring to FIG. 3, which is a schematic view showing the display device according to one embodiment of the present invention, the display device comprises an array substrate, a PCB, and a driving circuit arranged within a non-display region of the array substrate.

The driving circuit may comprise: a source driving circuit X; gate driving circuits Y1, Y2 and Y3; transmission lines L1, L2 and L3 that are in one-to-one correspondence to the gate driving circuits Y1, Y2 and Y3 and that are configured to transmit a control signal to the gate driving circuits Y1, Y2 and Y3; and three compensating resistors 103 coupled to the corresponding transmission line, so as to compensate for the resistance difference among the transmission lines L1, L2 and L3.

The transmission line L1 includes one PLG line 101 (between X and Y1), the transmission line L2 includes two PLG lines 101 (between X and Y1, and between Y1 and Y2), and the transmission line L3 includes three PLG lines 101 (between X and Y1, between Y1 and Y2, and between Y2 and Y3).

In this embodiment, a zero-ohm resistor may be coupled to each transmission line in advance, and the resistance of each PLG line 101 may be detected at a test stage of the display panel so as to obtain the resistance difference among the transmission lines. Then, the zero-ohm resistor for the corresponding transmission line may be replaced with the corresponding compensating resistor in accordance with the resistance difference.

The present disclosure further provides a method for implementing equal resistance of a plurality of transmission lines which are in one-to-one correspondence to a plurality of gate driving circuits and configured to transmit a control signal to the gate driving circuits, comprising the steps of:

S11, acquiring the resistance of each transmission line after the transmission lines have been prepared;

S12, calculating a resistance difference among the plurality of transmission lines; and S13, coupling the corresponding transmission line to a compensating resistor in accordance with the resistance difference among the plurality of transmission lines, so as to compensate for the resistance difference among the plurality of transmission lines.

The transmission line is configured to couple the gate driving circuit and the sequence controller on the PCB, and the sequence controller transmits the control signal to the gate driving circuit via the transmission line. Each gate driving circuit corresponds to an individual transmission line.

Among the control signals transmitted by the sequence controller to the gate driving circuit, a Voff signal has a high demand on synchronization. Hence, in this embodiment, the control signal may be the Voff signal, i.e., the transmission line is configured to transmit the Voff signal. Of course, the control signal may be any other signal, e.g., a Von signal.

Preferably, the transmission lines include at least one PLG line, through which the source driving circuit is coupled to each gate driving circuit. The resistance of the transmission lines is a sum of the resistance of all PLG lines on the transmission lines.

Preferably, prior to the step of acquiring the resistance of each transmission line, the method may further comprise: coupling a zero-ohm resistor to each transmission line in advance. At this time, the step of coupling the corresponding transmission line to the compensating resistor in accordance with the resistance difference among the plurality of transmission lines may comprise: replacing the zero-ohm resistor of the corresponding transmission line with the compensating resistor in accordance with the resistance difference among the plurality of transmission lines, so as to compensate for the resistance difference among the plurality of transmission lines.

According to the method of this embodiment, the compensating resistor is coupled to the corresponding transmission line so as to compensate for the resistance difference among the transmission lines. As a result, it is able to implement the equal resistance of the transmission lines accurately, to facilitate the implementation, and to reduce the cost.

The above are merely the preferred embodiments of the present invention. It should be appreciated that, a person skilled in the art may make further improvements and modifications without departing from the principle of the present invention, and these improvements and modifications shall also be considered as the scope of the present invention.

What is claimed is:

1. A method for implementing equal resistance of a plurality of transmission lines in one-to-one correspondence to a plurality of gate driving circuits and configured to transmit a control signal to the gate driving circuits, the method comprising:

coupling a zero-ohm resistor to each transmission line in advance;

acquiring a resistance value of each transmission line after the transmission lines have been prepared;

calculating a resistance value difference among the plurality of transmission lines; and coupling a corresponding transmission line to a compensating resistor in accordance with the resistance value difference among the plurality of transmission lines to compensate for the resistance value difference among the plurality of transmission lines, wherein the coupling the corresponding transmission line to the compensating resistor in accordance with the resistance difference among the plurality of transmission lines comprises:

replacing the zero-ohm resistor of the corresponding transmission line with the compensating resistor in accordance with the resistance difference among the plurality of transmission lines to compensate for the resistance difference among the plurality of transmission lines.

2. The method according to claim 1, wherein the transmission lines comprise connection gate lines through which a source driving circuit is coupled to each gate driving circuit, and the resistance value of the transmission lines is a sum of the resistance of all connection gate lines on the transmission lines.

3. The method according to claim 1, wherein the control signal is a Voff signal.

* * * * *